US008232959B2

(12) United States Patent
Choi et al.

(10) Patent No.: US 8,232,959 B2
(45) Date of Patent: Jul. 31, 2012

(54) METHOD OF DISPLAYING AN IMAGE AND ELECTROPHORETIC DISPLAY DEVICE FOR PERFORMING THE SAME

(75) Inventors: Uk-Chul Choi, Cheon-si (KR); Cheol-Woo Park, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 1161 days.

(21) Appl. No.: 12/056,461

(22) Filed: Mar. 27, 2008

(65) Prior Publication Data

US 2008/0259021 A1 Oct. 23, 2008

(30) Foreign Application Priority Data

Apr. 18, 2007 (KR) ..... 10-2007-0037716

(51) Int. Cl.
*G09G 3/34* (2006.01)

(52) U.S. Cl. ..... 345/107; 359/296

(58) Field of Classification Search ..... 345/107, 345/204, 690; 359/290, 296
See application file for complete search history.

(56) References Cited

U.S. PATENT DOCUMENTS 6,650,462 B2 * 11/2003 Katase ..... 359/296
2005/0280626 A1 * 12/2005 Amundson et al. ..... 345/107
2006/0290652 A1 * 12/2006 Zhou et al. ..... 345/107
2008/0122783 A1 * 5/2008 Jung et al. ..... 345/107

FOREIGN PATENT DOCUMENTS

| | | |
|---|---|---|
| JP | 2004-101938 | 4/2004 |
| JP | 2004-102054 | 4/2004 |
| KR | 2006-0025585 | 3/2006 |

* cited by examiner

*Primary Examiner* — Stephen Sherman
(74) *Attorney, Agent, or Firm* — Cantor Colburn LLP

(57) ABSTRACT

A method of displaying images on an electrophoretic display ("EPD") panel includes displaying a (K)-th image on the EPD panel including a plurality of electrophoretic particles, wherein K denotes a natural number. Then, when an interrupt signal for converting images is inputted during one of a plurality of driving intervals, a charge of the electrophoretic particles is compensated, which is charged in correspondence with the (K)-th image displayed on the EPD panel before the interrupt signal is inputted, and then a (K+1)-th image is displayed on the EPD panel. Thus, when the interrupt signal is inputted during one of the driving intervals displaying the (K)-th image data, the charges that are charged in the particles are compensated in correspondence to the (K)-th image data, and then the (K+1)-th image is displayed so that display quality may be enhanced.

24 Claims, 21 Drawing Sheets

METHOD OF DISPLAYING AN IMAGE AND ELECTROPHORETIC DISPLAY DEVICE FOR PERFORMING THE SAME

This application claims priority to Korean Patent Application No. 2007-37716, filed on Apr. 18, 2007, and all the benefits accruing therefrom under 35 U.S.C. §119, the contents of which in its entirety are herein incorporated by reference.

BACKGROUND OF THE INVENTION

1. Field of the Invention

The present invention relates to a method of displaying an image and an electrophoretic display ("EPD") device for performing the method. More particularly, the present invention relates to a method of displaying images on an EPD panel capable of improving a display quality and an EPD device for performing the method.

2. Description of the Related Art

Generally, an electrophoretic display ("EPD") device includes two opposing electrodes and a plurality of microcapsules. The microcapsules include a plurality of white ink particles that is negatively charged and a plurality of black ink particles that is positively charged. Only when an electric field is applied to the two electrodes, the white ink particles move in view direction to display white images and the black particles move in view direction to display black images. Lights applied from an external side are reflected by the white ink particles that move the view direction, so that images are displayed. That is, the white and black particles have a bi-stable characteristic. Since each microcapsule is stable in either of a black or a white state, each microcapsule maintains the black or white state without maintaining a voltage across the electrodes. Accordingly, power consumption for the EPD device is reduced.

When a plurality of charges corresponding to a direct current ("DC") voltage is charged to the particles having the bi-stable characteristics, a lifetime of the EPD device is decreased. In order to prevent the EPD device from decreasing its lifetime and a residual image, a method of compensating the particles moved by data, that is displayed in a previous frame before current data is displayed, has been developed. That is, in the EPD device for displaying an image, a driving interval includes a compensation interval, a display interval and a holding interval.

BRIEF SUMMARY OF THE INVENTION

In a conventional driving method of an electrophoretic display ("EPD") device, when a command (hereinafter, an interrupt signal) converting from a current image into a following image is inputted from a user during a driving interval of the EPD device, a driving for displaying the following image is started without compensating charges that are charged into the particles in correspondence with the image displayed in the current image. Accordingly, a charge compensation for the previous image is not performed, so that a residual image, a display deterioration, etc., may be generated.

The present invention provides a method of displaying an image on an EPD device capable of easing a charging compensation for a previous image when an image is converted.

The present invention also provides an EPD device for performing the above-mentioned method.

In exemplary embodiments of the present invention, there is provided a method of displaying images on an EPD panel.

In the above-mentioned method, a (K)-th image is displayed on the EPD panel including a plurality of electrophoretic particles, wherein K denotes a natural number. Then, when an interrupt signal for converting images is inputted during one of a plurality of driving intervals, a charge of the electrophoretic particles that are charged in correspondence with the (K)-th image displayed on the EPD panel before the interrupt signal is inputted, is compensated, and then a (K+1)-th image is displayed on the EPD panel.

In other exemplary embodiments of the present invention, an EPD device includes an EPD panel and a driving section. The EPD panel includes a plurality of electrophoretic particles. The driving section drives the EPD panel to display a (K)-th image on the EPD panel, wherein K denotes a natural number, when an interrupt signal for converting images is inputted during one of a plurality of driving intervals. The driving section drives the EPD panel to compensate a charge of the electrophoretic particles charged in correspondence with the (K)-th image displayed on the EPD panel before the interrupt signal is inputted. The driving section drives the EPD panel to display a (K+1)-th image on the EPD panel.

According to the above, when the interrupt signal is inputted during one of the driving intervals displaying the (K)-th image data, the charges that are charged in the particles are compensated in correspondence to the (K)-th image data, and then the (K+1)-th image is displayed, so that display quality may be enhanced.

BRIEF DESCRIPTION OF THE DRAWINGS

The above and other features and advantages of the present invention will become readily apparent by reference to the following detailed description when considered in conjunction with the accompanying drawings wherein.

DETAILED DESCRIPTION OF THE INVENTION

Figure 1:
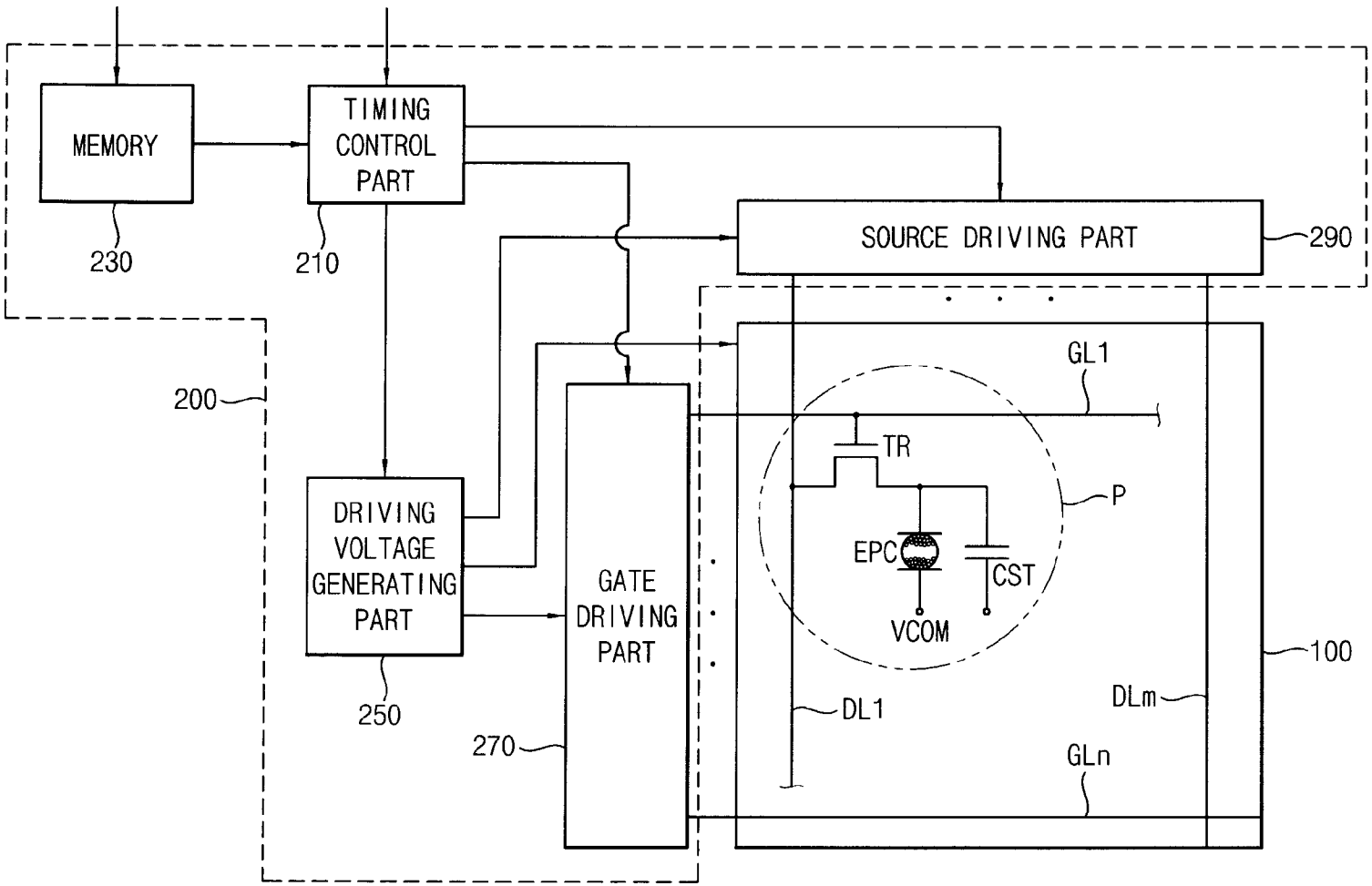
FIG. 1 is a block diagram illustrating an exemplary electrophoretic display ("EPD") device according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings.

Figure 2:
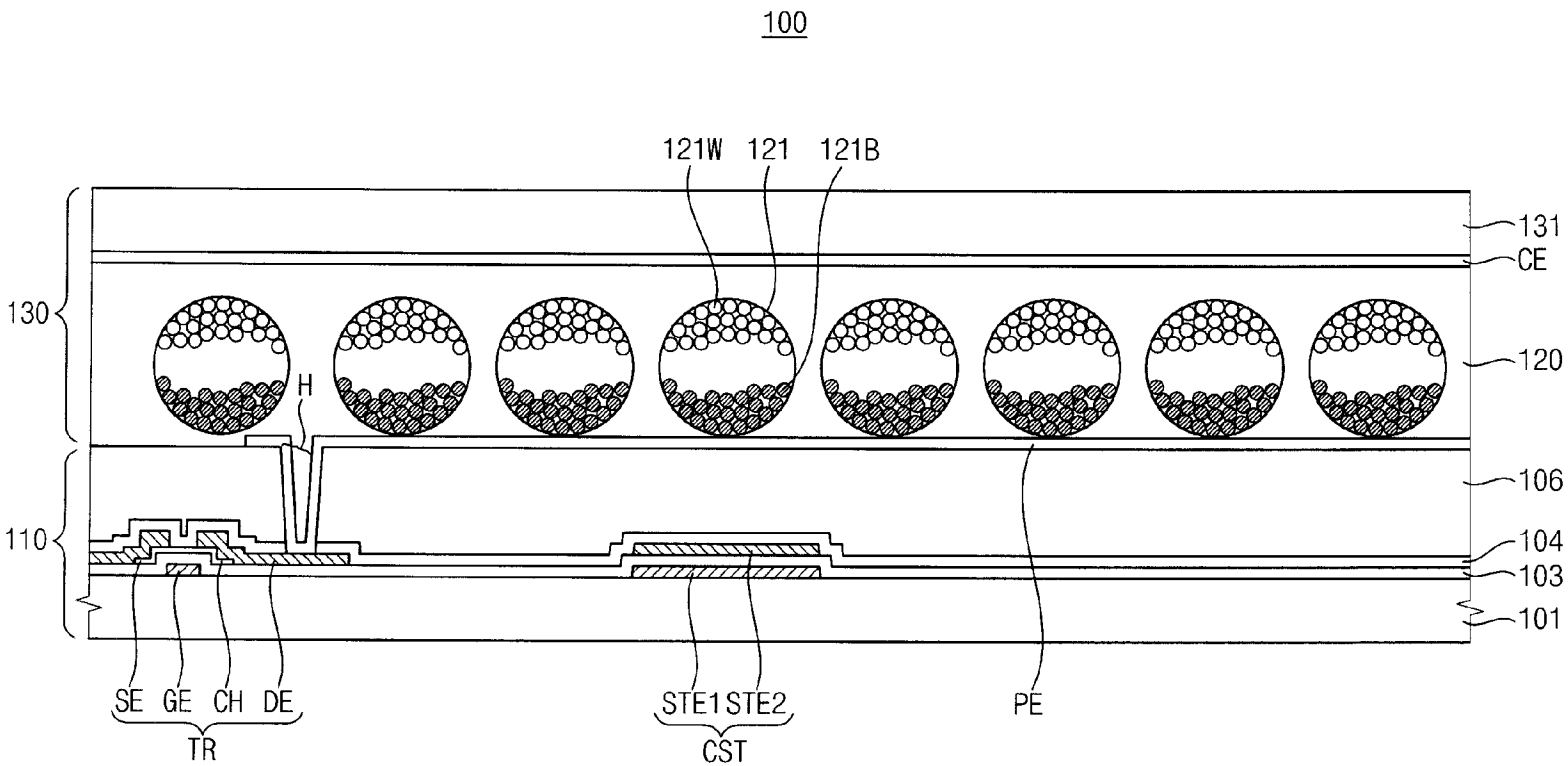
FIG. 2 is a cross-sectional view illustrating the exemplary EPD device of FIG. 1.

FIG. 1 is a block diagram illustrating an exemplary electrophoretic display ("EPD") device according to an exemplary embodiment of the present invention. FIG. 2 is a cross-sectional view illustrating the exemplary EPD device of FIG. 1.

Referring to FIGS. 1 and 2, an EPD device includes an EPD panel 100 and a driving section 200 that drives the EPD panel 100.

The EPD panel 100 includes a plurality of pixel parts P. Each of the pixel parts P includes a switching element TR electrically connected to a gate line GL and a source line DL, an electrophoretic capacitor EPC electrically connected to the switching element TR and a storage capacitor CST electrically connected to the switching element TR. In more detail, the EPD panel 100 includes an array substrate 110 and an electrophoretic film 130 as shown in FIG. 2.

The array substrate 110 includes a first base substrate 101. A plurality of gate lines GL1 to GLn, a plurality of source lines DL1 to DLm, a plurality of switching elements TRs, a plurality of pixel electrodes PE and a plurality of storage capacitors CST are formed on the first substrate 101. Here, 'n' and 'm' are natural numbers. The gate lines GL1 to GLn are extended along a first direction. The source lines DL1 to DLm are extended along a second direction across the first direction. In an exemplary embodiment, the first direction may be substantially perpendicular to the second direction. The switching elements TR are electrically connected to the gate lines GL1 to GLn and the source lines DL1 to DLm. The pixel electrodes PE are electrically connected to the switching elements TR. The storage capacitors CST are electrically connected to the switching elements TR.

The switching element TR includes a gate electrode GE, a gate insulation layer 103, a channel part CH, a source electrode SE and a drain electrode DE. The gate electrode GE is electrically connected to the gate line GL1, for example. The gate insulation layer 103 is formed on the gate electrode GE, and is further formed on the gate lines GL1 to GLn and on exposed surfaces of the first base substrate 101. The channel part CH is formed on the gate insulation layer 103 to overlap with the gate electrode GE. The source electrode SE and drain electrode DE are formed on the channel part CH. The source electrode SE is spaced apart from the drain electrode DE. The source electrode SE is electrically connected to the source line DL1, for example. The protecting layer 104 and organic layer 106 are sequentially formed on the switching element TR, and are formed on exposed surfaces of the gate insulation layer 103. The pixel electrode PE is formed on the organic layer 106, and is electrically connected to the drain electrode DE through a contact hole H formed in the protecting layer 104 and the organic layer 106.

The storage capacitor CST may include a first storage electrode STE1, the gate insulation layer 103 and a second storage electrode STE2. The first storage electrode STE1 may be formed on the first base substrate 101 and is electrically connected to a storage common electrode. The gate insulation layer 103 is formed on the first storage electrode STE1. The second storage electrode STE2 is formed on the gate insulation layer 103 to be overlapped with the first storage electrode STE1. The second storage electrode STE2 may be electrically connected to the pixel electrode PE.

The electrophoretic film 130 includes a second base substrate 131, a common electrode CE and an electrophoretic layer 120. The second base substrate 131 may include a flexible material. For example, the second base substrate 131 may include a plastic material such as a polyethyleneterephthalate ("PET") that is excellent in light transmittance, thermal resistance, chemical resistance, physical strength, etc.

The common electrode CE includes an optically transparent and electrically conductive material. The common electrode CE facing the pixel electrode PE, receives a common voltage VCOM. The common electrode CE may include, for example, indium tin oxide ("ITO"), indium zinc oxide ("IZO"), amorphous-indium tin oxide ("a-ITO"), etc. These may be used alone or in a combination thereof.

The electrophoretic layer 120 includes a plurality of microcapsules 121 and a binder (not shown) combining the microcapsules 121 to one another. The microcapsules 121 include a plurality of electrophoretic particles that are negatively or positively charged. For example, the microcapsules 121 may include a plurality of white ink particles 121W negatively or positively charged and a plurality of black ink particles 121B differently (or inversely) charged from the white ink particles 121W. In one exemplary embodiment, the white ink particles 121W may be negatively charged, and the black ink particles 121B may be positively charged. An exemplary driving method of the electrophoretic layer 120 is as follows.

When a positive voltage +V that is a first polarity voltage with respect to the common voltage VCOM is applied to the pixel electrode PE, the white ink particles 121W negatively charged are moved towards the pixel electrode PE, and the black ink particles 121B positively charged are moved towards the common electrode CE. Therefore, a black image is displayed on the EPD panel 100. Alternatively, when a negative voltage −V that is a second polarity voltage with respect to the common voltage VCOM is applied to the pixel electrode PE, the black ink particles 121B positively charged are moved towards the pixel electrode PE, and the white ink particles 121W negatively charged are moved towards the common electrode CE. Therefore, a white image is displayed on the EPD panel 100. When the common voltage VCOM is applied to the pixel electrode PE, a moving of the white and black particles 121W and 121B may be stopped to maintain the current position. That is, the image displayed on the EPD panel 100 may be held.

The driving section 200 includes a timing control part 210, a memory 230, a driving voltage generating part 250, a gate driving part 270 and a source driving part 290.

The timing control part 210 controls the driving section 200 based on an external control signal including a horizontal synchronizing signal and a vertical synchronizing signal that are received from an external device.

The memory 230 stores a data received from an external device by image unit of one screen.

The driving voltage generating part 250 generates a driving voltage. The driving voltage includes a gate voltage provided to the gate driving part 270, a source voltage applied to the source driving part 290 and a common voltage VCOM applied to the EPD panel 100. The gate voltage includes a gate on voltage and a gate off voltage for generating a gate signal. The source voltage may include a positive voltage +V, a common voltage VCOM, and a negative voltage −V. Alternatively, the source voltage may include a power voltage VDD for generating the positive and negative voltages +V and −V.

The gate driving part 270 generates the gate signal using the gate voltage in response to a control of the timing control part 210. The gate driving part 270 sequentially outputs the gate signal to the gate lines GL1 to GLn.

The source driving part 290 outputs the positive voltage +V, the common voltage VCOM and the negative voltage −V to the source lines DL1 to DLm in response to a control of the timing control part 210.

Figure 3A:
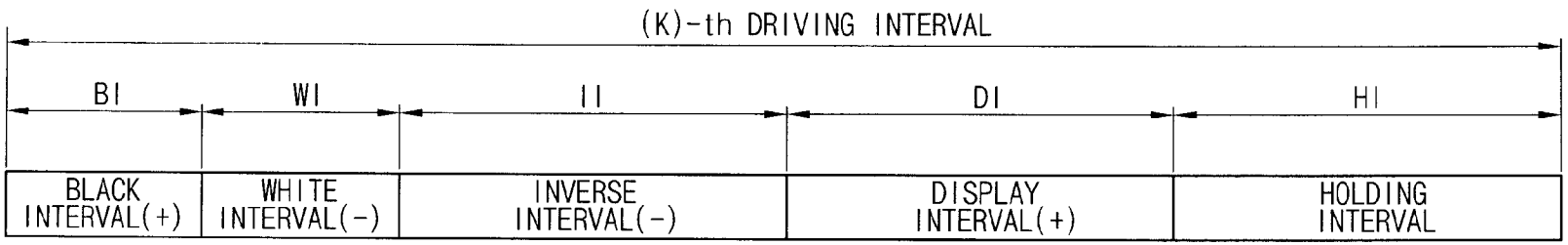
FIGS. 3A and 3B are timing diagrams illustrating the exemplary EPD device of FIG. 1.
Figure 3B:
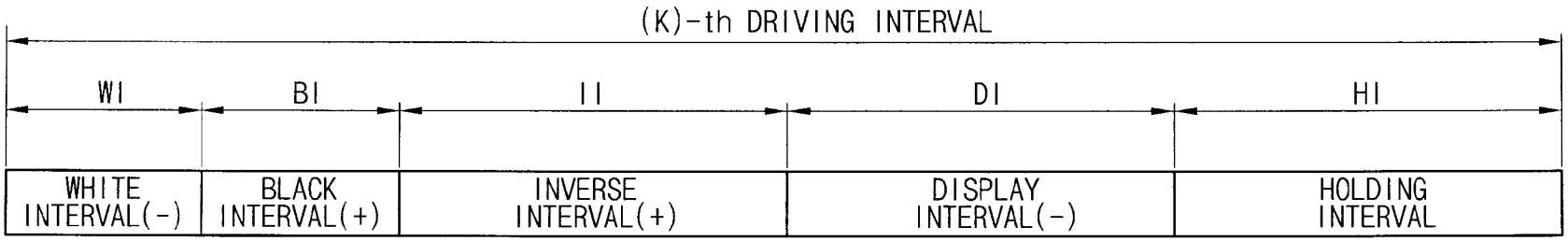

FIGS. 3A and 3B are timing diagrams illustrating the exemplary EPD device of FIG. 1.

FIG. 3A is a timing diagram illustrating when a black image is displayed on a white background image.

Referring to FIGS. 1 and 3A, a driving interval for displaying a (K)-th image on the EPD panel 100 includes a black interval BI, a white interval WI, an inverse interval II, a display interval DI and a holding interval HI.

The black interval BI is an interval during which a positive voltage +V is outputted to display a black image on the EPD panel 100, and the white interval WI is an interval during which a negative voltage −V is outputted to display a white image on the EPD panel 100. The inverse interval II is an interval during which an inversed data of the (K)-th image is applied to the EPD panel 100, and the display interval DI is an interval during which the (K)-th image is displayed on the EPD panel 100. The inverse interval II is an interval during which a negative voltage −V is outputted to the EPD panel 100, and the display interval DI is an interval during which a positive voltage +V is outputted to the EPD panel 100. The holding interval HI is an interval during which the (K)-th image displayed on the EPD panel 100 is held during the display interval DI.

Each of the black interval BI and the white interval WI has a first time interval t1, and each of the white intervals WI has a second time interval t2. The first time interval t1 is greater than the second time interval t2. Since the black and white intervals BI and WI are intervals that initialize the previous image, that is, the (K−1)-th image, the black and white intervals BI and WI have the maximum time interval during which a black gradation and a white gradation are displayed on the EPD panel 100. For example, when a black gradation is in a data signal of the (K)-th image, the first and second time intervals t1 and t2 are substantially identical to each other.

The black interval BI and the white interval WI are driving intervals for initializing the (K−1)-th image, and the inverse interval II is a driving interval for compensating a charge of the particles for the (K)-th image displayed on the EPD panel 100 in the current image.

FIG. 3B is a timing diagram illustrating when a white image is displayed on a black background image.

Referring to FIGS. 1 and 3B, the driving interval for displaying (K)-th image on the EPD panel 100 includes a white interval WI, a black interval BI, an inverse interval II, a display interval DI and a holding interval HI.

The white interval WI is an interval during which a negative voltage −V is outputted to the EPD panel 100 to display a white image, and the black interval BI is an interval during which a positive voltage +V is outputted to the EPD panel 100 to display a black image. The inverse interval II is an interval during which an inversed data of the (K)-th image data is applied to the EPD panel 100. That is, the inverse interval II is an interval during which a positive voltage +V is outputted to the EPD panel 100. The display interval DI is an interval during which the (K)-th image is displayed on the EPD panel 100. The holding interval HI is an interval during which the (K)-th image displayed on the EPD panel 100 is held during the display interval DI.

The exemplary embodiment of FIG. 3B is a case where a sequence of the white interval WI and a sequence of the black interval BI are changed from one another and image voltages applied to the inverse interval II and the display interval DI are changed from a negative voltage −V to a positive voltage +V or from a positive voltage +V to a negative voltage −V in comparison with the exemplary embodiment of FIG. 3A. That is, in the exemplary embodiment of FIG. 3B, the white image is displayed on the EPD panel 100 displaying the (K−1)-th image, and then the black image is displayed on the EPD panel 100, so as to initialize the EPD panel 100.

FIGS. 4A to 4G are schematic diagrams illustrating an exemplary image driving method of the exemplary EPD device of FIGS. 1 and 3A.

Figure 4A:
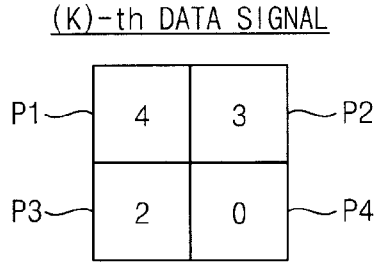
FIGS. 4A to 4G are schematic diagrams illustrating an exemplary image driving method of the exemplary EPD device of FIG. 1.

Referring to FIGS. 1, 3A and 4A, the timing control part 210 reads a (K)-th image data (or a page data) stored in the memory 230. The (K)-th image data (or the (K)-th page data) that is read from the memory 230 will be described as follows with reference to FIG. 4A.

The (K)-th image data includes "4" (i.e., 0-gray) corresponding to the first pixel part P1, "3" (i.e., 1-gray) corresponding to the second pixel part P2, "2" (i.e., 2-gray) corresponding to the third pixel part P3 and "0" (i.e., 4-gray) corresponding to the fourth pixel part P4. Here, it is assumed that the 0-gray is a gradation that a black image is displayed, and the 4-gray is a gradation that a white image is displayed.

The timing control part 210 controls the source driving part 290 in correspondence with the (K)-th image data that is read from the memory 230.

Figure 4B:
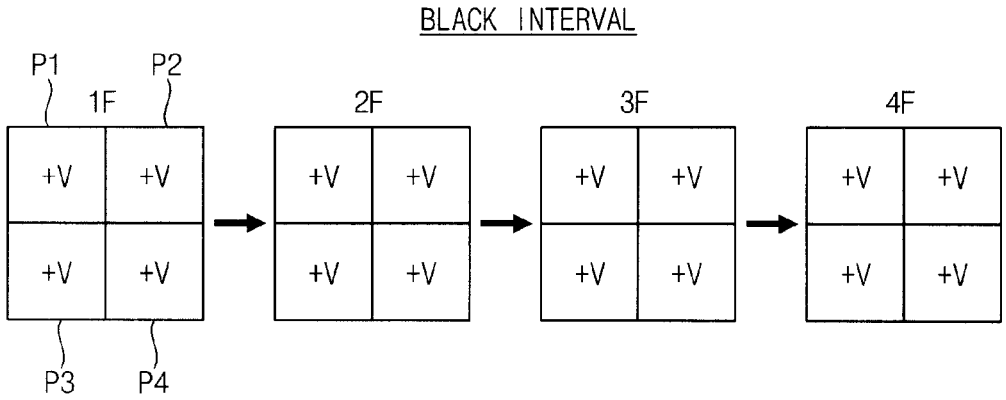

Referring to FIGS. 1, 3A and 4B, the timing control part 210 controls the source driving part 290 so that the source driving part 290 outputs a positive voltage +V during the black interval BI.

The black interval BI is set by a response speed according to a voltage of electrophoretic particles. In this exemplary embodiment, four frames are assumed.

The source driving part 290 repeatedly outputs a positive voltage +V to the first, second, third and fourth pixel parts P1, P2, P3 and P4 during from a first frame 1F of the black interval BI to a fourth frame 4F of the black interval BI.

Accordingly, the white ink particles 121W negatively charged are moved to the pixel electrode PE, and the black ink particles 121B positively charged are moved to the common electrode CE so that a black image is displayed on the EPD panel 100. That is, when a positive voltage +V with respect to the common voltage VCOM is applied to the first, second, third and fourth pixel parts P1, P2, P3 and P4 during the first frame 1F, the white ink particles 121W are moved towards the pixel electrode PE, and the black ink particles 121B are moved towards the common electrode CE so that the first, second, third and fourth pixel parts P1, P2, P3 and P4 display a 1-gradation image. Alternatively, when a positive voltage +V is repeatedly applied to the first, second, third and fourth pixel parts P1, P2, P3 and P4 during the second to fourth frames 2F, 3F and 4F, the first, second, third and fourth pixel parts P1, P2, P3 and P4 display a 4-gradation image.

Figure 4C:
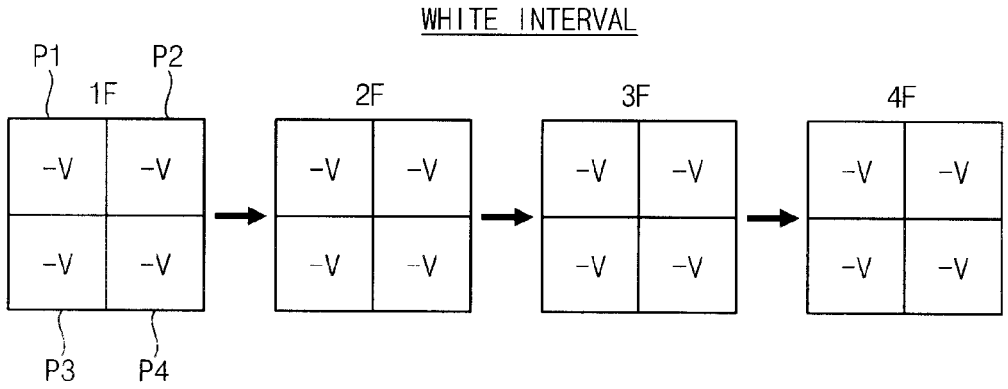

Referring to FIGS. 1, 3A and 4C, the timing control part 210 controls the source driving part 290 so that the source driving part 290 outputs a negative voltage −V during the white interval WI. In this embodiment, the white interval WI and the black interval BI are substantially identical to each other. Here, it is assumed that each of the white interval WI and the black interval BI is four frames.

The source driving part 290 outputs the negative voltage −V to the first, second, third and fourth pixel parts P1, P2, P3 and P4 during from a first frame 1F to a fourth frame 4F of the white interval WI. Therefore, the black ink particles 121B positively charged are moved towards the pixel electrode PE, and the white ink particles 121W negatively charged are moved towards the common electrode CE so that the first, second, third and fourth pixel parts P1, P2, P3 and P4 display a white image.

That is, when the negative voltage −V is outputted to the first, second, third and fourth pixel parts P1, P2, P3 and P4 during the first frame 1F, the white ink particles 121W are moved towards the common electrode CE, and the black ink particles 121B are moved towards the pixel electrode PE. As a result, the first, second, third and fourth pixel parts P1, P2, P3 and P4 display a 3-gradation image that is a −1 gradation converted from the 4-gradation image displayed during the black interval BI. Using the same method, when the negative voltage −V is repeatedly outputted to the first, second, third and fourth pixel parts P1, P2, P3 and P4 during from the second frame to the fourth frame, the first, second, third and fourth pixel parts P1, P2, P3 and P4 display a 0-gradation image.

Referring to FIGS. 1, 3A, 4D and 4E, the timing control part 210 controls the source driving part 290 so that the source driving part 290 outputs a negative voltage −V corresponding to an inversion data signal of the (K)-th image during the inverse interval II.

Figure 4D:
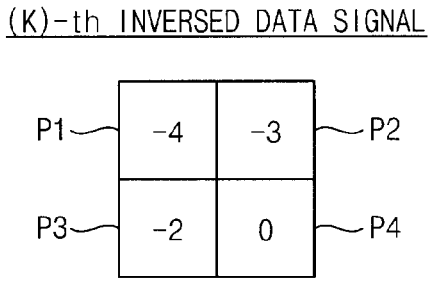

Referring to FIG. 4D, an inverse data that is inversed from the (K)-th image data includes "−4" corresponding to the first pixel part P1, "−3" corresponding to the second pixel part P2, "−2" corresponding to the third pixel part P3 and "0" corresponding to the fourth pixel part P4.

For example, the source driving part 290 outputs a negative voltage −V to the first, second and third pixel parts P1, P2 and P3 during a first frame 1F of the inverse interval II, and outputs the common voltage VCOM to the fourth pixel part P4.

The source driving part 290 outputs a negative voltage −V to the first, second and third pixel parts P1, P2 and P3 during a second frame 2F of the inverse interval II, and outputs the common voltage VCOM to the fourth pixel part P4.

The source driving part 290 outputs a negative voltage −V to the first and second pixel parts P1 and P2 during a third frame 3F of the inverse interval II, and outputs the common voltage VCOM to the third and fourth pixel parts P3 and P4.

The source driving part 290 outputs a negative voltage −V to the first pixel part P1 during a fourth frame 4F of the inverse interval II, and outputs the common voltage VCOM to the second, third and fourth pixel parts P2, P3 and P4.

As a result, the negative voltage −V is applied to the first pixel part P1 during four frames of the inverse interval II, and the negative voltage −V is applied to the second pixel part P2 during three frames of the inverse interval II. Moreover, the negative voltage −V is applied to the third pixel part P3 during two frames of the inverse interval II, and the common voltage VCOM is applied to the fourth pixel part P4 during four frames of the inverse interval II.

Therefore, during the inverse interval II, the negative voltage −V is again applied to the EPD panel 100 in the white image state that is displayed through the white interval WI. That is, the white particles 121W of the EPD panel 100 are already moved towards the common electrode CE so that a white state is realized during the white interval WI. Additionally, the negative voltage −V is again applied to the pixel electrode PE, so that the black particles 121B are not moved towards the common electrode CE, and a result, a charging compensation effect may be obtained.

Referring to FIGS. 1, 3A, 4A and 4F, the timing control part 210 controls the source driving part 290 so that the source driving part 290 outputs a positive voltage +V corresponding to the (K)-th image data during the display interval DI.

The (K)-th image data includes "4" corresponding to the first pixel part P1, "3" corresponding to the second pixel part P2, "2" corresponding to the third pixel part P3 and "0" corresponding to the fourth pixel part P4.

For example, the source driving part 290 outputs a positive voltage +V to the first, second and third pixel parts P1, P2 and P3 during a first frame 1F of the display interval DI, and outputs a common voltage VCOM to the fourth pixel part P4.

The source driving part 290 outputs a positive voltage +V to the first, second and third pixel parts P1, P2 and P3 during a second frame 2F of the display interval DI, and outputs the common voltage VCOM to the fourth pixel part P4.

The source driving part 290 outputs a positive voltage +V to the first and second pixel parts P1 and P2 during a third frame 3F of the display interval DI, and outputs the common voltage VCOM to the third and fourth pixel parts P3 and P4.

The source driving part 290 outputs a positive voltage +V to the first pixel part P1 during a fourth frame 4F of the display interval DI, and outputs the common voltage VCOM to the second, third and fourth pixel parts P2, P3 and P4.

As a result, the positive voltage +V is applied to the first pixel part P1 during four frames of the display interval DI, and the positive voltage +V is applied to the second pixel part P2 during three frames of the display interval DI. Moreover, the positive voltage +V is applied to the third pixel part P3 during two frames of the display interval DI, and the common voltage VCOM is applied to the fourth pixel part P4 during the four frames of the display interval DI. Therefore, the (K)-th image is displayed on the first, second, third and fourth pixel parts P1, P2, P3 and P4. When the display interval DI is finished, the charging compensation of the (K)-th driving interval is also finished.

Figure 4E:
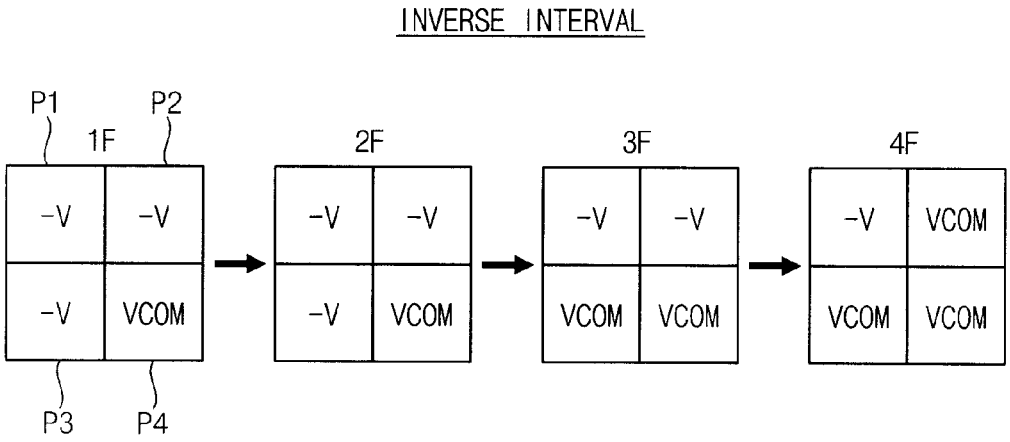
Figure 4F:
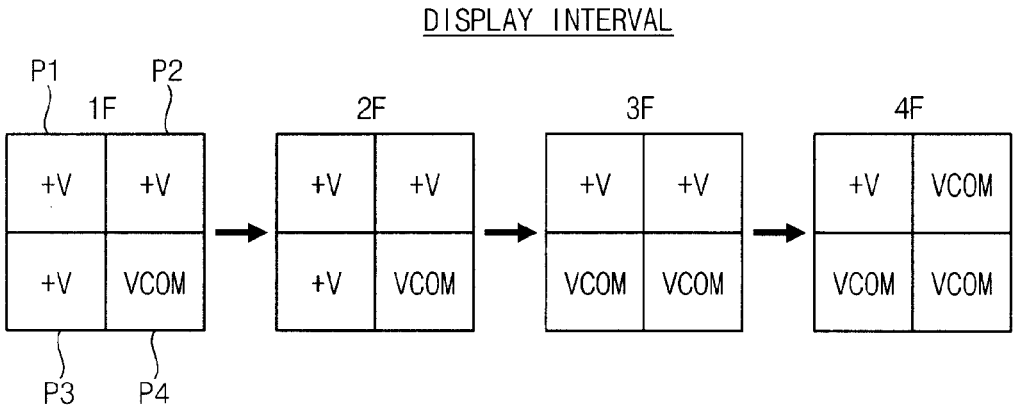
Figure 4G:
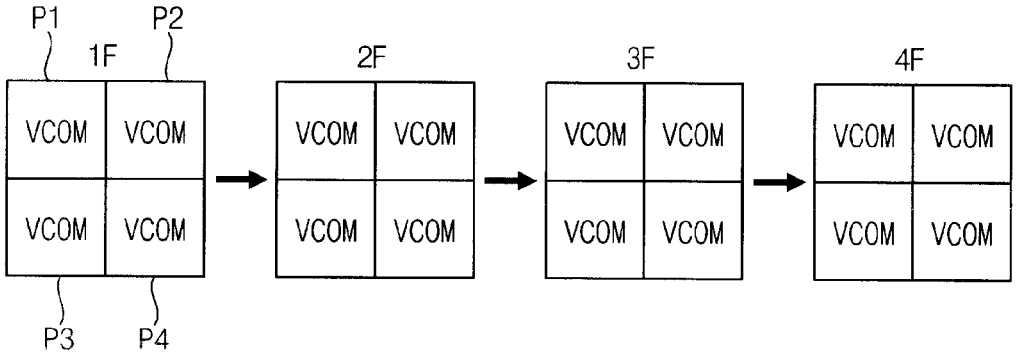

Referring to FIGS. 1, 3A and 4G, the timing control part 210 controls the source driving part 290 so that the source driving part 290 holds a data displayed on the first, second, third and fourth pixel parts P1, P2, P3 and P4 during the hold interval HI. The source driving part 290 outputs the common voltage VCOM to the first, second, third and fourth pixel parts P1, P2, P3 and P4 during the holding interval HI. Here, it is assumed that the holding interval HI is four frames.

When the identical voltage potential is formed between two electrodes of the electropheritic particles, that is the common electrode CE and the pixel electrode PE, the common voltage VCOM is applied to the first, second, third and fourth pixel parts P1, P2, P3 and P4 during the holding interval HI in accordance with characteristics holding the previous moving state. Therefore, the image, which is displayed on the first, second, third and fourth pixel parts P1, P2, P3 and P4, is maintained during the display interval DI. The holding interval HI may be variously set in accordance with characteristics of the EPD device.

When the holding interval HI is finished, a (K+1)-th driving interval starts in order to display the (K+1)-the image on the EPD panel 100. The (K+1)-th driving interval includes a black interval BI, a white interval WI, an inverse interval II, a display interval DI and a holding interval HI, which may be driven by the same method as the above-described (K)-th driving interval.

In FIG. 3A, the black image displayed on a white background image is described. Alternatively, a white image may be displayed on a black background image. For example, with reference to FIGS. 1, 3B and 4C, the source driving part 290 outputs a negative voltage −V to the first, second, third and fourth pixel parts P1, P2, P3 and P4 during the white interval WI so that the first, second, third and fourth pixel parts P1, P2, P3 and P4 display a white image.

Referring to FIGS. 1, 3B and 4B, the source driving part 290 outputs a positive voltage +V to the first, second, third and fourth pixel parts P1, P2, P3 and P4 during the black interval BI so that the first, second, third and fourth pixel parts P1, P2, P3 and P4 display a black image.

Referring to FIGS. 1, 3B, 4D and 4E, the source driving part 290 outputs a positive voltage +V corresponding to an inverse data signal of the (K)-th image, during the inverse interval II. Here, a polarity of the inverse data signal of the (K)-th image is opposite to that of the signal as shown in FIGS. 4D and 4E.

For example, the positive voltage +V is applied to the first pixel part P1 during from a first frame 1F to a fourth frame 4F, the positive voltage +V is applied to the second pixel part P2 during from the first frame 1F to the third frame 3F. The positive voltage +V is applied to the third pixel part P3 during the first frame 1F to the second frame 2F, and a common voltage VCOM is applied to the fourth pixel part P4 during the first to fourth frames 1F to 4F.

Referring to FIGS. 1, 3B, 4A and 4F, the source driving part 290 outputs a negative voltage −V corresponding to a data signal of the (K)-th image, during the display interval DI. Here, a polarity of the data signal of the (K)-th image is opposite to that of the signal as shown in FIGS. 4A and 4F.

For example, the negative voltage −V is applied to the first pixel part P1 during from a first frame 1F to a fourth frame 4F, and the negative voltage −V is applied to the second pixel part P2 during from the first frame 1F to the third frame 3F. The negative voltage −V is applied to the third pixel part P3 during the first frame 1F to the second frame 2F, and a common voltage VCOM is applied to the fourth pixel part P4 during from the first frame 1F to the fourth frame 4F. Therefore, the first, second, third and fourth pixel parts P1, P2, P3 and P4 display the (K)-th image.

Referring to FIGS. 1, 3B and 4G, the source driving part 290 outputs the common voltage VCOM to the first, second, third and fourth pixel parts P1, P2, P3 and P4 during the holding interval HI to maintain the (K)-th image.

Hereinafter, an exemplary driving method for driving the (K+1)-th image data will be described in detail, when the interrupt signal for an image changing is inputted from a user during the driving interval driving the (K)-th image data, that is, a first black interval, a first white interval, a first inverse interval, a first display interval and a first holding interval.

Figure 5A:
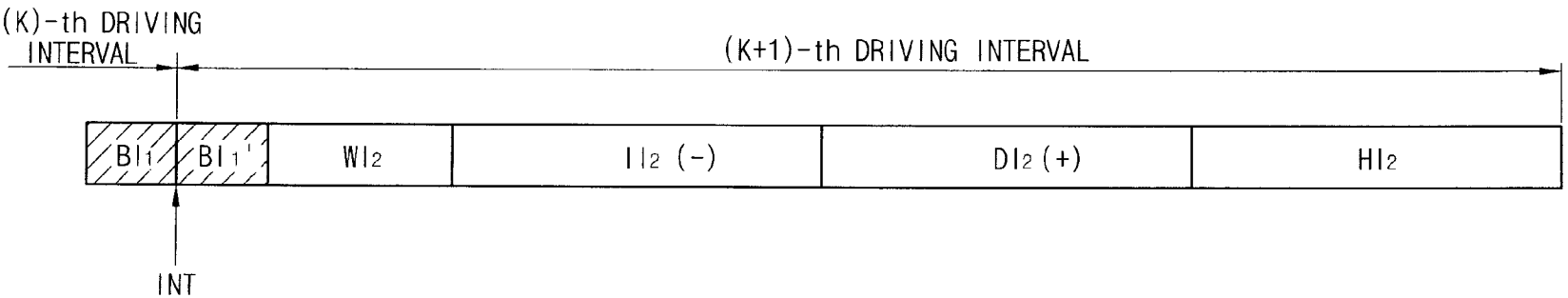
FIGS. 5A and 5B are timing diagrams illustrating when an interrupt signal is generated during a black interval and a white interval according to a first exemplary embodiment of the present invention.
Figure 5B:
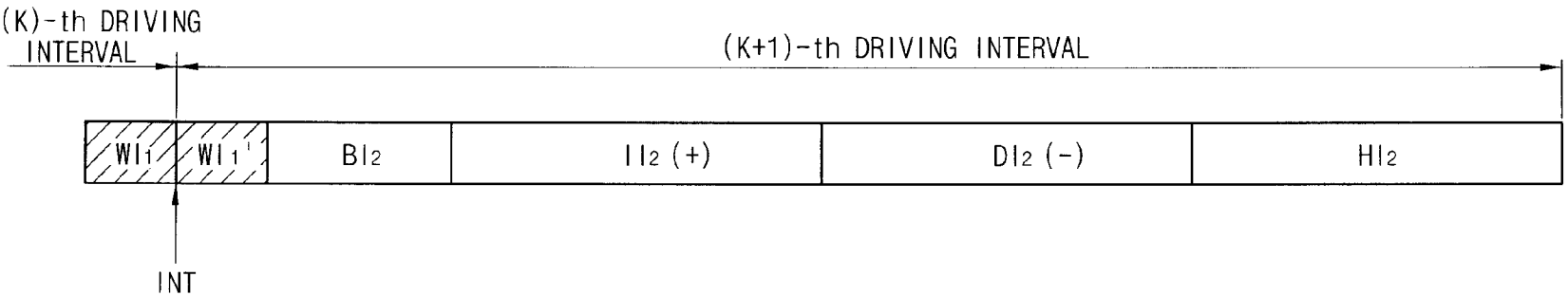

FIGS. 5A and 5B are timing diagrams illustrating when an interrupt signal is generated during a black interval and a white interval according to a first exemplary embodiment of the present invention. FIG. 5A is a timing diagram illustrating when an interrupt signal is generated during a black interval according to the exemplary driving method as shown in FIG. 3A.

Referring to FIGS. 1, 3A and 5A, the interrupt signal INT is inputted from a user during the first black interval BI1 of the interval driving the (K)-th image data (hereinafter, the (K)-th driving interval).

The driving section 200 determines the interval during which the interrupt signal INT of the first black interval BI1 is inputted, and outputs the positive voltage +V to the EPD panel 100 during the remaining black interval BI1' of the first black interval BI1 that is generated after the interrupt signal INT is inputted to display a black image.

The first black interval BI1 is a predetermined interval, so that the driving section 200 may determine the remaining black interval BI1' after the interrupt signal INT is inputted. The driving section 200 continuously outputs the positive voltage +V to the EPD panel 100 during a portion of the first black interval BI1 and the remaining interval BI1' to display the black image.

Then, the driving section 200 outputs the negative voltage −V to the EPD panel 100 during the second white interval WI2 to display a white image.

The driving section 200 outputs the negative voltage −V in correspondence to an inversion data of the (K+1)-th image data to the EPD panel 100 during a second inversion interval II2, and outputs the positive voltage +V in correspondence to the (K+1)-th image data to the EPD panel 100 during a second display interval DI2.

Then, the driving section 200 outputs a common voltage VCOM to the EPD panel 100 during a second holding interval HI2 to hold the (K+1)-th image displayed on the EPD panel 100. When the second display interval DI2 is finished, a charging compensation during the (K+2)-th driving interval may be finished.

FIG. 5B is a timing diagram illustrating when an interrupt signal is generated during a white interval according to the exemplary driving type as shown in FIG. 3B.

Referring to FIGS. 1, 3B and 5B, the driving section 200 determines an interval of the first white interval WI1, during which the interrupt signal INT is inputted, and outputs a negative voltage −V to the EPD panel 100, during the remaining white interval WI1' of the first white interval WI1 after the interrupt signal INT is inputted, so as to display a white image. Then, the driving section 200 outputs a positive voltage +V to the EPD panel 100, during a second black interval BI2, to display a black image.

The driving section 200 outputs the positive voltage +V corresponding to an inverse data of the (K+1)-th image data, during a second inverse interval II2, and outputs the negative voltage −V corresponding to the (K+1)-th image data to the EPD panel 100 during a second display interval DI2. Then, the driving section 200 outputs a common voltage VCOM to the EPD panel 100 during a second holding interval HI2 to maintain the (K+1)-th image displayed on the EPD panel 100. When the second display interval DI2 is finished, the charging compensation of the (K+2)-th driving interval is finished.

Figure 6A:
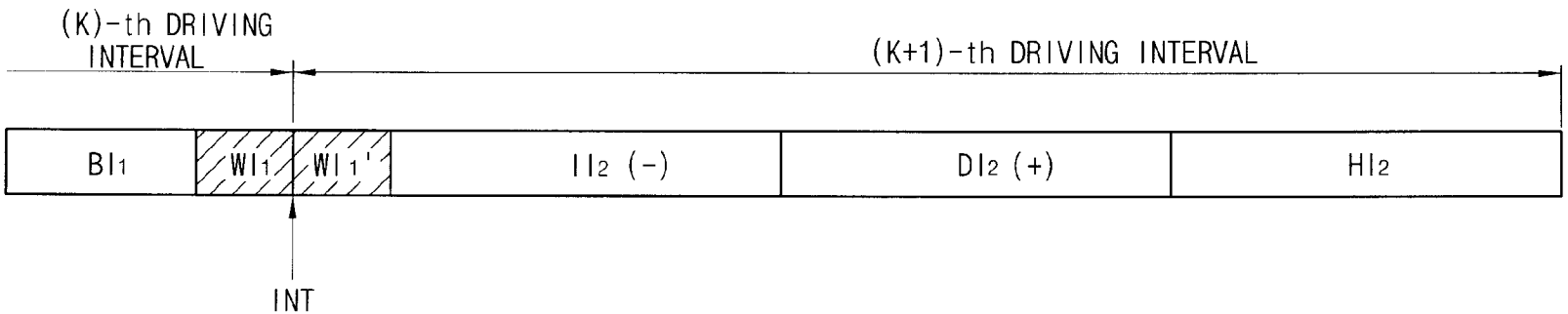
FIGS. 6A and 6B are timing diagrams illustrating when an interrupt signal is generated during a white interval and a black interval according to a second exemplary embodiment of the present invention.
Figure 6B:
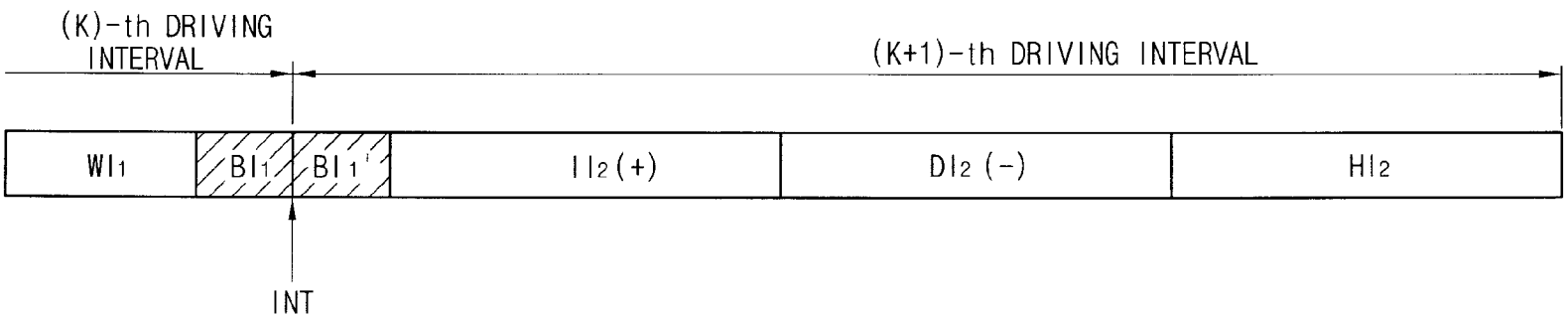

FIGS. 6A and 6B are timing diagrams illustrating when an interrupt signal is generated during a white interval and a black interval according to a second exemplary embodiment of the present invention. FIG. 6A is a timing diagram illustrating when an interrupt signal is generated during a white interval according to the exemplary driving type as shown in FIG. 3A.

Referring to FIGS. 1, 3A and 6A, the interrupt signal INT is inputted from a user during a first white interval WI1 of the interval driving the (K)-th image data.

The driving section 200 determines the interval during which the interrupt signal INT of the first white interval WI1 is inputted, and outputs the negative voltage −V to the EPD panel 100, during the remaining white interval WI1' of the first white interval WI1 that is generated after the interrupt signal INT is inputted, so as to display a white image.

The first white interval WI1 is a predetermined interval, so that the driving section 200 may determine the remaining white interval WI1' after the interrupt signal INT is inputted. The driving section 200 continuously outputs the negative voltage −V to the EPD panel 100, during a portion of the white interval WI1 of the (K)-th driving interval and the remaining white interval WI1', so as to display the white image.

The driving section 200 outputs the negative voltage −V corresponding to an inverse data of the (K+1)-th image data to the EPD panel 100 during a second inverse interval II2, and outputs the positive voltage +V corresponding to the (K+1)-th image data to the EPD panel 100 during a second display interval DI2 to display the (K+1)-th image. Then, the driving section 200 outputs the common voltage VCOM to the EPD panel 100 during a second holding interval HI2 to maintain the (K+1)-th image displayed on the EPD panel 100.

FIG. 6B is a timing diagram illustrating when an interrupt signal is generated during a black interval according to the exemplary driving method as shown in FIG. 3B.

Referring to FIGS. 1, 3B and 6B, the driving section 200 determines the interval during which the interrupt signal INT of the first black interval BI1 is inputted, and outputs the positive voltage +V to the EPD panel 100 during the remaining black interval BI1' of the first black interval BI1 that is generated after the interrupt signal INT is inputted to display a black image.

The driving section 200 outputs the positive voltage +V corresponding to an inverse data of the (K+1)-th image data to the EPD panel 100 during a second inverse interval II2, and outputs the negative voltage −V corresponding to the (K+1)-th image data to the EPD panel 100 during a second display interval DI2 to display the (K+1)-th image. Then, the driving section 200 outputs the common voltage VCOM to the EPD panel 100 during a second holding interval HI2 to maintain the (K+1)-th image displayed on the EPD panel 100.

FIGS. 7A to 7D are timing diagrams illustrating when an interrupt signal is generated during an inverse interval according to a third exemplary embodiment of the present invention.

Figure 7A:
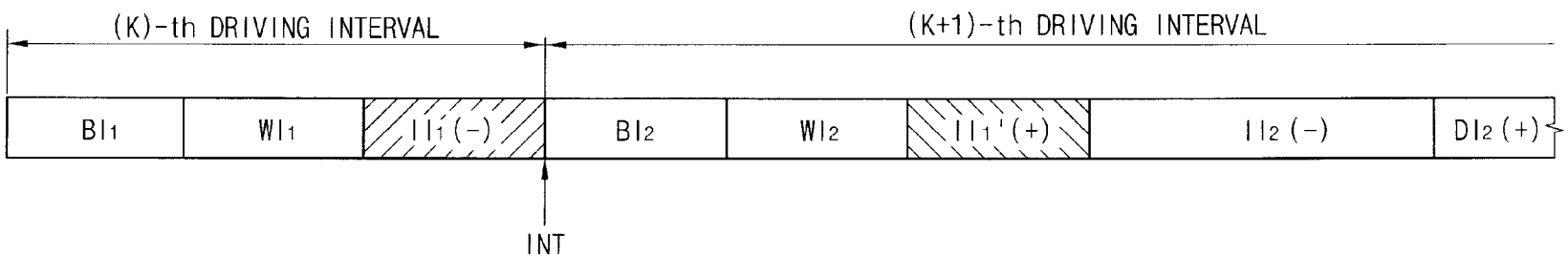
FIGS. 7A to 7D are timing diagrams illustrating when an interrupt signal is generated during an inverse interval according to a third exemplary embodiment of the present invention.
Figure 7B:
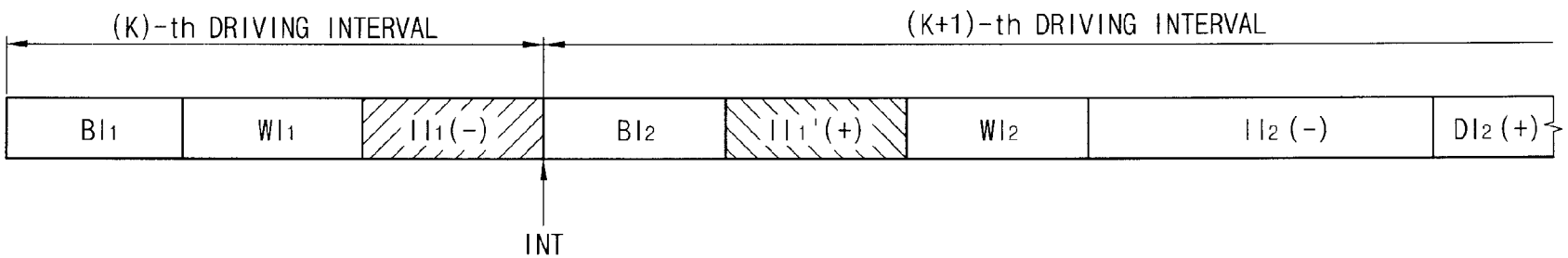

FIGS. 7A and 7B are timing diagrams illustrating when an interrupt signal is generated during an inverse interval according to the exemplary driving method as shown in FIG. 3A.

Referring to FIGS. 1, 3A and 7A, the interrupt signal INT is inputted from a user during a first inverse interval II1 of the interval driving the (K)-th image data.

The driving section 200 determines the first inverse interval II1 during which the interrupt signal INT is inputted. The driving section 200 compensates charges that are charged in the particles of the EPD panel 100 during the first inverse interval II1 before the interrupt signal INT is inputted to display a (K+1)-th image on the EPD panel 100.

For example, the driving section 200 outputs the positive voltage +V to the EPD panel 100 during a second black interval BI2 after the interrupt signal INT is inputted to display a black image on the EPD panel 100, and outputs the negative voltage −V during a second white interval WI2 to display a white image on the EPD panel 100.

Then, the driving section 200 outputs the positive voltage +V during an inverse compensation interval II1', in order to compensate charges that are charged in the particles by the negative voltage −V outputted to the EPD panel 100 during the first inverse interval II1 before the interrupt signal INT is inputted. The first inverse interval II1 before the interrupt signal INT is inputted and the inverse compensation interval II1' may be substantially identical to each other.

The driving section 200 outputs the negative voltage −V corresponding to an inverse data of a (K+1)-th image data to the EPD panel 100, during a second inverse interval II2 after the inverse compensation interval II1', and outputs the positive voltage +V corresponding to (K+1)-th image data during a second display interval DI2 to display the (K+1)-th image data.

Then, although not shown in FIG. 7A, the driving section 200 outputs the common voltage VCOM to the EPD panel 100 during a second holding interval HI2 to maintain the (K+1)-th image displayed on the EPD panel 100.

Referring to FIGS. 1, 3A and 7B, the driving section 200 outputs the positive voltage +V to the EPD panel 100, during a second black interval BI2 after the interrupt signal INT is inputted, to display a black image.

The driving section 200 then outputs the positive voltage +V during an inverse compensation interval II1', in order to compensate charges that are charged in the particles by the negative voltage −V outputted to the EPD panel 100 during the first inverse interval II1 before the interrupt signal INT is inputted. The first inverse interval II1 before the interrupt signal INT is inputted and the inverse compensation interval II1' may be substantially identical to each other.

Then, the driving section 200 outputs the negative voltage −V to display a white image during a second white interval WI2, and outputs the negative voltage −V corresponding to an inverse data of a (K+1)-th image data to the EPD panel 100, during a second inverse interval II2. The driving section 200 outputs a positive voltage +V corresponding to the (K+1)-th image data to display the (K+1)-th image during a second display interval DI2, and outputs the common voltage VCOM to the EPD panel 100 during a second holding interval HI2, not shown in FIG. 7B, to maintain the (K+1)-th image displayed on the EPD panel 100.

Figure 7C:
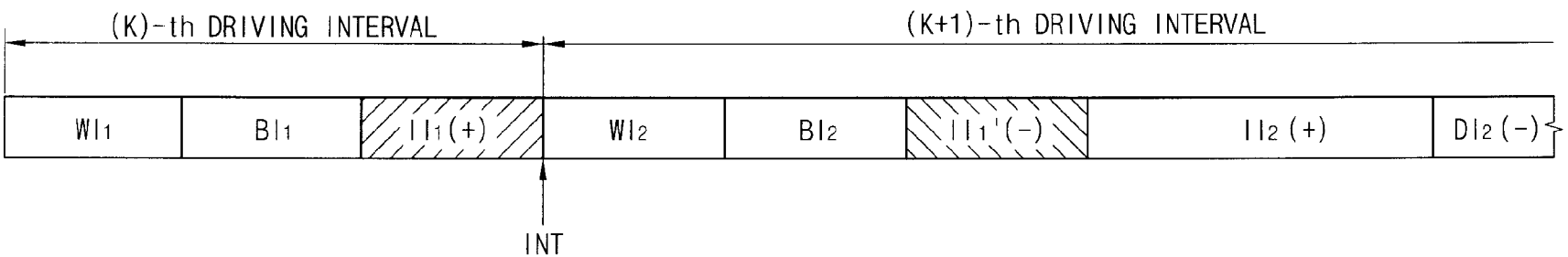
Figure 7D:
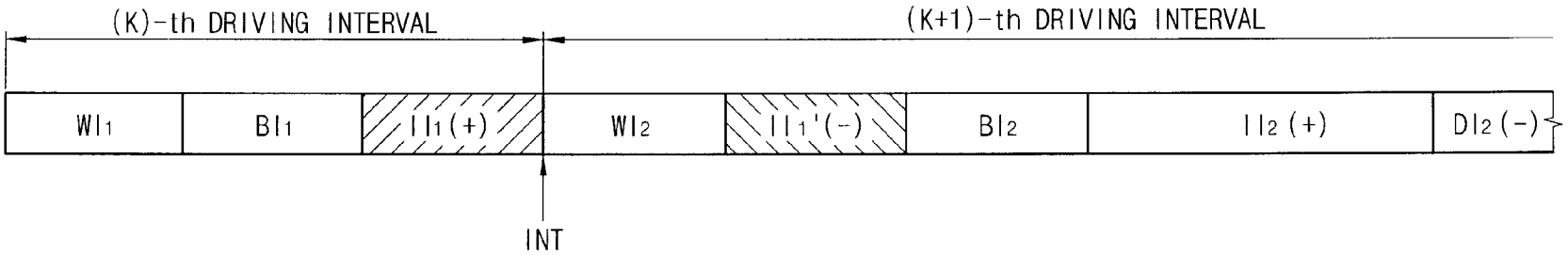

FIGS. 7C and 7D are timing diagrams illustrating when an interrupt signal is generated during an inverse interval according to the exemplary driving method as shown in FIG. 3B.

Referring to FIGS. 1, 3B and 7C, the driving section 200 outputs the negative voltage −V to the EPD panel 100 during a second white interval WI2 after the interrupt signal INT is inputted to display a white image, and outputs the positive voltage +V during a second black interval BI2 to display a black image.

Then, the driving section 200 outputs the negative voltage −V during an inverse compensation interval II1', in order to compensate charges that are charged in the particles by the positive voltage +V outputted to the EPD panel 100 during the first inverse interval II1 before the interrupt signal INT is inputted. The first inverse interval II1 before the interrupt signal INT is inputted and the inverse compensation interval II1' may be substantially identical to each other.

The driving section 200 outputs the positive voltage +V corresponding to an inverse data of a (K+1)-th image data to the EPD panel 100, during a second inverse interval II2 after the inverse compensation interval II1', and outputs the negative voltage −V corresponding to (K+1)-th image data during a second display interval DI2 to display the (K+1)-th image data. Then, the driving section 200 outputs the common voltage VCOM to the EPD panel 100 during a second holding interval HI2, not shown in FIG. 7C, to maintain the (K+1)-th image displayed on the EPD panel 100.

Referring to FIGS. 1, 3B and 7D, the driving section 200 outputs the negative voltage −V to the EPD panel 100, during a second white interval WI2 after the interrupt signal INT is inputted, to display a white image.

Then, the driving section 200 outputs the negative voltage −V during an inverse compensation interval II1', in order to compensate charges that are charged in the particles by the positive voltage +V outputted to the EPD panel 100 during the first inverse interval II1 before the interrupt signal INT is inputted. The first inverse interval II1 before the interrupt signal INT is inputted and the inverse compensation interval II1' may be substantially identical to each other.

The driving section 200 outputs the positive voltage +V to display a black image during a second black interval BI2. The driving section 200 outputs the positive voltage +V corresponding to an inverse data of a (K+1)-th image data to the EPD panel 100 during a second inverse interval II2, and outputs a negative voltage −V corresponding to the (K+1)-th image data to display the (K+1)-th image during a second display interval DI2. Then, the driving section 200 outputs the common voltage VCOM to EPD panel 100 during a second holding interval HI2, not shown in FIG. 7D, to maintain the (K+1)-th image displayed on the EPD panel 100.

Hereinafter, the interrupt signal INT inputted during a second frame 2F of a first inverse interval II1 of a (K)-th driving interval will be described in detail.

During a first frame 1F of the first inverse interval II1, the −V, −V, −V and VCOM are outputted to the first, second, third and fourth pixel parts P1, P2, P3, P4, respectively, and during a second frame 2F of the first inverse interval II1, each of the −V, −V, −V and VCOM is outputted to the first, second, third and fourth pixel parts P1, P2, P3, P4, respectively, in correspondence to an inverse data of the first, second, third and fourth pixel parts P1, P2, P3 and P4.

The positive voltage +V is applied to the first, second, third and fourth pixel parts P1, P2, P3 and P4 during first and second frames of the inverse compensation interval II1', in order to compensate charges that are charged in the particles of the first, second, third and fourth pixel parts P1, P2, P3 and P4. For example, each of the +V, +V, +V and VCOM is applied to the first, second, third and fourth pixel parts P1, P2, P3 and P4 during a first frame 1F of the inverse compensation interval II1', and each of the +V, +V, +V and VCOM is applied to the first, second, third and fourth pixel parts P1, P2, P3 and P4 during a second frame 2F of the inverse compensation interval II1', so that a charge of the particles may be compensated.

Therefore, an inversed charge with respect to the charge that is charged in the particles during the first inverse interval II1 before the interrupt signal INT, is applied to the EPD panel 100 during the inverse compensation interval II1' so that the charge of the electropheric particles of the EPD panel 100 may be compensated.

FIGS. 8A to 8D are timing diagrams illustrating when an interrupt signal is generated during a display interval according to a fourth exemplary embodiment of the present invention.

Figure 8A:
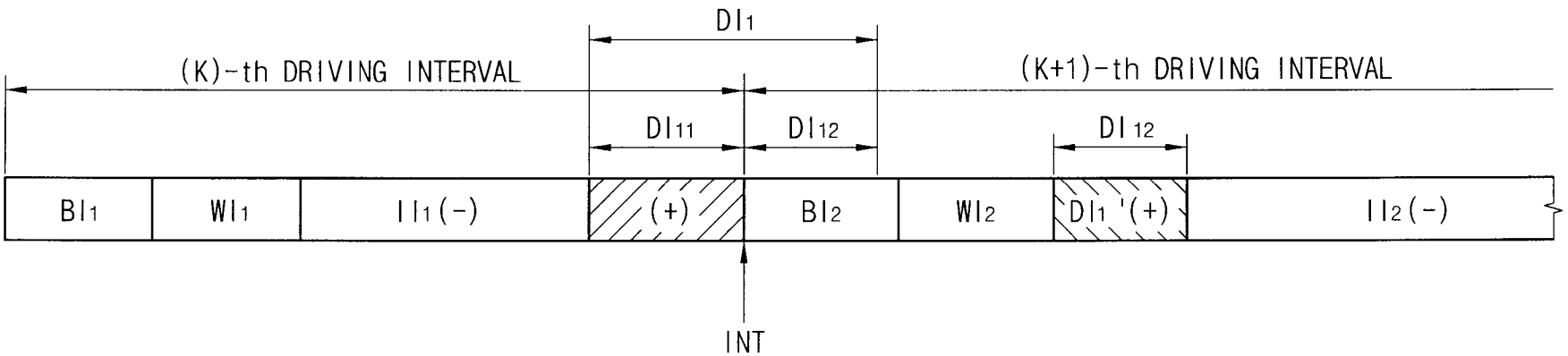
FIGS. 8A to 8D are timing diagrams illustrating when an interrupt signal is generated during a display interval according to a fourth exemplary embodiment of the present invention.
Figure 8B:
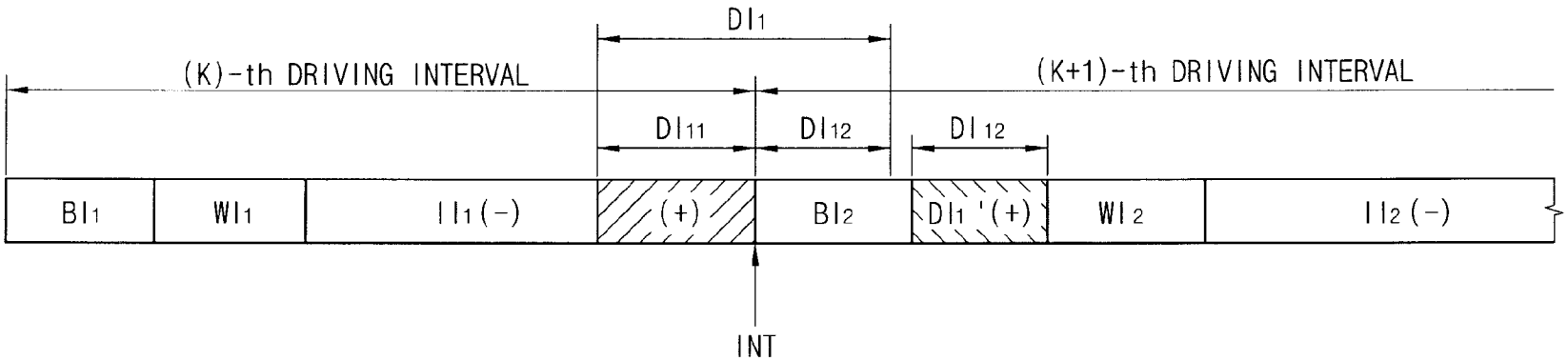

FIGS. 8A and 8B are timing diagrams illustrating when an interrupt signal is generated during a display interval according to the exemplary driving method as shown in FIG. 3A.

Referring to FIGS. 1, 3A and 8A, the interrupt signal INT is inputted from a user during the display interval DI1 of the interval driving the (K)-th image data.

The driving section 200 may determine the first display interval DI1 during which the interrupt signal INT is inputted. For example, the first display interval DI1 includes a first interval DI11 before the interrupt signal INT is inputted from the user, and a second interval DI12 after the interrupt signal INT is inputted from the user.

The driving section 200 may compensate the charge of the particles, which are charged in the EPD panel 100 during the first interval DI11 before the interrupt signal INT is inputted from the user, and displays the (K+1)-th image. The charge compensating method will be described as follows.

The negative voltage −V corresponding to the inverse data of the (K)-th image has been charged into the particles during the first inverse interval II1 before the first display interval DI1. That is, the charge of the positive voltage +V corresponding to the (K)-th image data has been already compensated during the first inverse interval II1.

Therefore, the driving section 200 controls the particles so that the particles are charged with a positive voltage +V during the second interval DI12 after the interrupt signal INT is inputted. Therefore, the positive voltage +V is charged in the particles by control of the driving section 200, during a display compensation interval DI1' that has a length identical to that of the second interval DI12.

For example, the driving section 200 outputs the positive voltage +V to the EPD panel 100 during a second black interval BI2 after the interrupt signal INT is inputted to display a black image, and outputs the negative voltage −V to the EPD panel 100 during a second white interval WI2 to display a white image.

The driving section 200 outputs the positive voltage +V to the EPD panel 100 during the display compensation interval DI1', which will be applied to the EPD panel 100 during the second interval DI12 after the interrupt signal INT is inputted. A length of the first display interval DI1 may be substantially identical to a total sum of a length of the first interval DI11 before the interrupt signal INT is inputted and a length of the display compensation interval DI1'.

Then, the driving section 200 outputs the negative voltage −V corresponding to an inverse data of the (K+1)-th image during a second inverse interval II2, and outputs the positive voltage +V corresponding to the (K+1)-th image data during a second display interval DI2, not shown in FIG. 8A, to display the (K+1)-th image on the EPD panel 100. Then, the driving section 200 outputs the common voltage VCOM to the EPD panel 100 to maintain the (K+1)-th image displayed on the EPD panel 100 during a second holding interval HI2, not shown in FIG. 8A.

Referring to FIGS. 1, 3A and 8B, the driving section 200 outputs the positive voltage +V to the EPD panel 100 during a second black interval BI2 after the interrupt signal INT is inputted to display a black image.

The driving section 200 outputs the positive voltage +V to the EPD panel 100 during the display compensation interval DI1', which will be applied to the EPD panel 100 during the second interval DI12 after the interrupt signal INT is inputted. Here, a length of the first display interval DI1 may be substantially identical to a total sum of a length of the first interval DI11 before the interrupt signal INT is inputted and a length of the display compensation interval DI1'.

When the display compensation interval DI1' is realized in sequence with the second black interval BI2, a gray that is displayed by a positive voltage +V outputted during the display compensation interval DI1' is not recognized by the user, so that an eyesore is not generated in comparison with the exemplary driving method of FIG. 8A.

Then, the driving section 200 outputs the negative voltage −V to the EPD panel 100 during a second white interval WI2 to display a white image, and outputs the negative voltage −V corresponding to an inverse data of the (K+1)-th image data during a second inverse interval II2.

The driving section 200 outputs the positive voltage +V corresponding to the (K+1)-th image data to the EPD panel 100 during a second display interval DI2, not shown in FIG. 8B, to display the (K+1)-th image on the EPD panel 100, and outputs the common voltage VCOM to the EPD panel 100 during a second holding interval HI2, not shown in FIG. 8B, to maintain the (K+1)-th image displayed on the EPD panel 100.

Figure 8C:
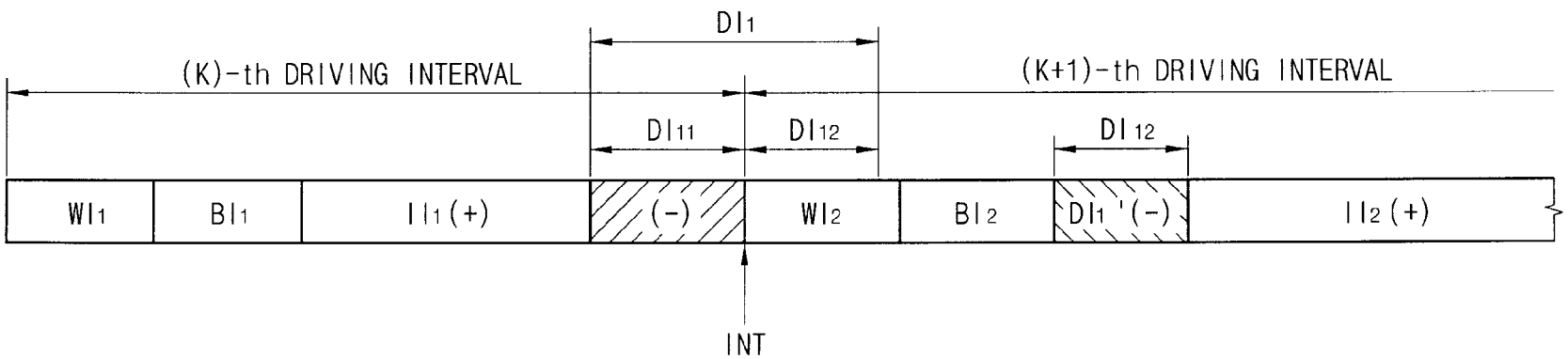
Figure 8D:
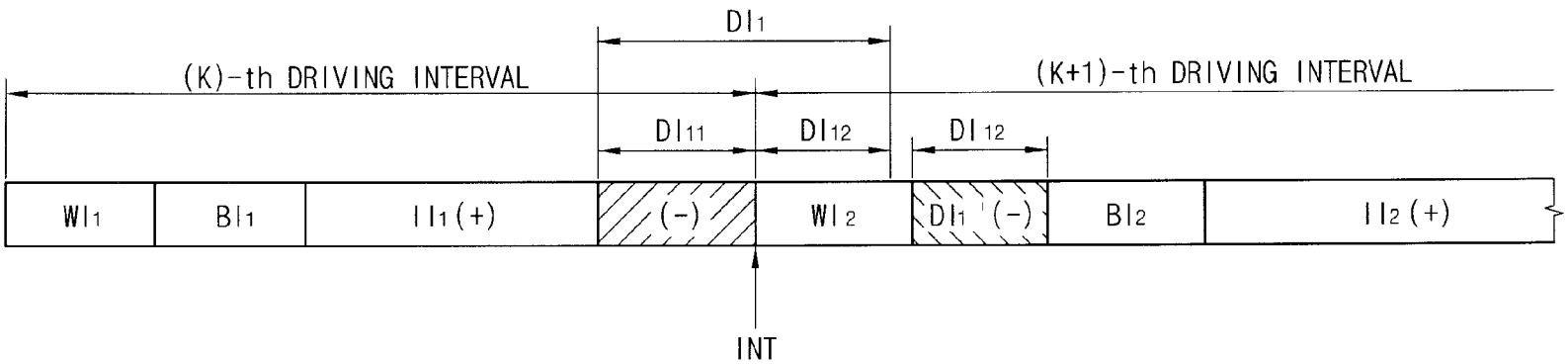

FIGS. 8C and 8D are timing diagrams illustrating when an interrupt signal is generated during a display interval according to the exemplary driving methods as shown in FIG. 3B.

Referring to FIGS. 1, 3B and 8C, the driving section 200 outputs the negative voltage −V to the EPD panel 100 during a second white interval WI2 after the interrupt signal INT is inputted to display a white image, and outputs the positive voltage +V to the EPD panel 100 during a second black interval BI2 to display a black image.

The driving section 200 outputs the negative voltage −V to the EPD panel 100 during the display compensation interval DI1', which will be applied to the EPD panel 100 during the second interval DI12 after the interrupt signal INT is inputted. A length of the first display interval DI1 may be substantially identical to a total sum of a length of the first interval DI11 before the interrupt signal INT is inputted and a length of the display compensation interval DI1'.

Then, the driving section 200 outputs the positive voltage +V corresponding to an inverse data of the (K+1)-th image during a second inverse interval II2, and outputs the negative voltage −V corresponding to the (K+1)-th image data during a second display interval DI2, not shown in FIG. 8C, to display the (K+1)-th image on the EPD panel 100. Then, the driving section 200 outputs the common voltage VCOM to the EPD panel 100 during a second holding interval HI2, not shown in FIG. 8C, to maintain the (K+1)-th image displayed on the EPD panel 100.

Referring to FIGS. 1, 3B and 8D, the driving section 200 outputs the negative voltage −V to the EPD panel 100 during a second white interval WI2 after the interrupt signal INT is inputted to display a white image.

The driving section 200 outputs the negative voltage −V to the EPD panel 100 during the display compensation interval DI1', which will be applied to the EPD panel 100 during the second interval DI12 after the interrupt signal INT is inputted. A length of the first display interval DI1 may be substantially identical to a total sum of a length of the first interval DI11 before the interrupt signal INT is inputted and a length of the display compensation interval DI1'.

The driving section 200 outputs the positive voltage +V during a second black interval BI2 to display a black image, and outputs the positive voltage +V corresponding to an inverse data of the (K+1)-th image during a second inverse interval II2.

The driving section 200 outputs the negative voltage −V corresponding to the (K+1)-th image data to the EPD panel 100 during a second display interval DI2, not shown in FIG. 8D, to display the (K+1)-th image, and outputs the common voltage VCOM to the EPD panel 100 during a second holding interval HI2, not shown in FIG. 8D, to maintain the (K+1)-th image displayed on the EPD panel 100.

Figure 9A:
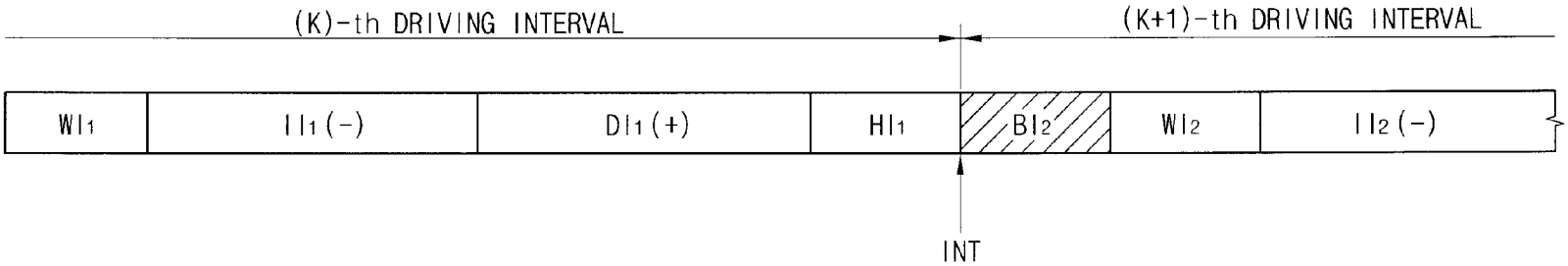
FIGS. 9A and 9B are timing diagrams illustrating when an interrupt signal is generated during a holding interval according to a fifth exemplary embodiment of the present invention.
Figure 9B:
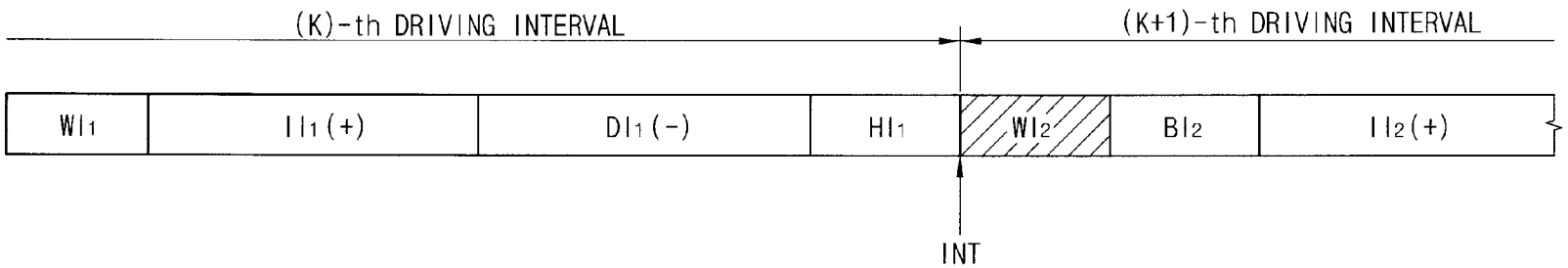

FIGS. 9A and 9B are timing diagrams illustrating when an interrupt signal is generated during a holding interval according to a fifth exemplary embodiment of the present invention. FIG. 9A is a timing diagram illustrating when an interrupt signal is generated during a holding interval according to the exemplary driving type as shown in FIG. 3A.

Referring to FIGS. 1, 3A and 9A, the interrupt signal INT is inputted from a user during a first holding interval HI1 of an interval driving the (K)-th image data.

When the interrupt signal INT is inputted within the first holding interval HI1, the driving section 200 drives the EPD panel 100 to display the (K+1)-th image on the EPD panel 100 after the interrupt signal INT is inputted.

The driving section 200 outputs a positive voltage +V to the EPD panel 100 during a second black interval BI2 after the interrupt signal INT is inputted to display a black image, and outputs a negative voltage −V to the EPD panel 100 during a second white interval WI2 to display a white image. The driving section 200 outputs a negative voltage −V to the EPD panel 100 in correspondence to an inverse data of the (K+1)-th image data during a second inverse interval II2, and outputs a positive voltage +V in correspondence to the (K+1)-th image data to the EPD panel 100 during a second display interval DI2, not shown in FIG. 9A. The driving section 200 outputs a common voltage VCOM, during a second holding interval HI2, not shown in FIG. 9A, to maintain the (K+1)-th image displayed on the EPD panel 100.

FIG. 9B is a timing diagram illustrating when an interrupt signal is generated during a holding interval according to the exemplary driving method as shown in FIG. 3B.

Referring to FIGS. 1, 3B and 9B, the driving section 200 outputs a negative voltage −V to the EPD panel 100 to display a white image during the second white interval WI2 after the interrupt signal INT is inputted, and outputs a positive voltage +V to the EPD panel 100 to display a black image during the second black interval BI2. Then, the driving section 200 displays a (K+1)-th image during the second inverse interval II2, the second display interval DI2 and the second holding interval HI2.

As described above, when the interrupt signal is inputted during one of driving intervals displaying the (K)-th image data, the charges that are charged in the particles are compensated in correspondence to the (K)-th image data, and then the (K+1)-th image is displayed so that a residual image and a deterioration of the particles may be prevented.

Moreover, a charging compensation is simplified by the driving intervals during which the interrupt signal is inputted, and another image is displayed, so that image-changing characteristics may be enhanced.

Although the exemplary embodiments of the present invention have been described, it is understood that the present invention should not be limited to these exemplary embodiments but various changes and modifications can be made by one of ordinary skill in the art within the spirit and scope of the present invention as hereinafter claimed.

What is claimed is:

1. A method of displaying images on an electrophoretic display panel, the method comprising:

displaying a (K)-th image on the electrophoretic display panel comprising a plurality of electrophoretic particles, wherein K denotes a natural number; and compensating a charge of the electrophoretic particles charged in correspondence with the (K)-th image displayed on the electrophoretic display panel before an interrupt signal for converting images is inputted, and displaying a (K+1)-th image on the electrophoretic display panel, when the interrupt signal is inputted during one of a plurality of driving intervals, wherein displaying the (K)-th image on the electrophoretic display panel comprises:

displaying a black image on the electrophoretic display panel using a first polarity voltage, during a first black interval;

displaying a white image on the electrophoretic display panel using a second polarity voltage, during a first white interval;

outputting the second polarity voltage corresponding to an inverse data of the (K)-th image to the electrophoretic display panel, during a first inverse interval subsequent the first white interval and the first black interval;

outputting the first polarity voltage corresponding to the (K)-th image data to display the (K)-th image on the electrophoretic display panel, during a first display interval subsequent the first inverse interval; and outputting a common voltage to the electrophoretic display panel to hold the (K)-th image displayed on the electrophoretic display panel, during a first holding interval subsequent the first display interval.

2. The method of claim 1, wherein, when the interrupt signal is inputted during the first black interval, displaying the (K+1)-th image on the electrophoretic display panel comprises:

outputting the first polarity voltage to the electrophoretic display panel, during a remaining first black interval generated after the interrupt signal is inputted, to display the black image;

outputting the second polarity voltage to the electrophoretic display panel, during a second white interval, to display the white image on the electrophoretic display panel;

outputting the second polarity voltage corresponding, during a second inverse interval, to an inverse data of the (K+1)-th image to the electrophoretic display panel;

outputting the first polarity voltage corresponding to (K+1)-th image data to the electrophoretic display panel, during a second display interval, to display the (K+1)-th image on the electrophoretic display panel; and outputting the common voltage to the electrophoretic display panel, during a second holding interval, to hold the (K+1)-th image displayed on the electrophoretic display panel.

3. The method of claim 1, wherein, when the interrupt signal is inputted during the first white interval, displaying the (K+1)-th image on the electrophoretic display panel comprises:

outputting the second polarity voltage to the electrophoretic display panel, during a remaining first white interval generated after the interrupt signal is inputted, to display the white image;

outputting the second polarity voltage corresponding to an inverse data of the (K)-th image data to the electrophoretic display panel, during a second inverse interval;

outputting the first polarity voltage corresponding to (K+1)-th image data to the electrophoretic display panel, during a second display interval, to display the (K+1)-th image on the electrophoretic display panel; and outputting the common voltage to the electrophoretic display panel, during a second holding interval, to hold the (K+1)-th image displayed on the electrophoretic display.

4. The method of claim 1, wherein, when the interrupt signal is inputted during the first inverse interval, displaying the (K+1)-th image on the electrophoretic display panel comprises:

outputting the first polarity voltage to the electrophoretic display panel, during a second black interval remaining after the interrupt signal is inputted, to display the black image;

outputting the second polarity voltage to the electrophoretic display panel, during a second white interval, to display the white image on the electrophoretic display panel;

outputting the first polarity voltage to the electrophoretic display panel, during an inverse compensation interval, to compensate a charge charged in the particles before the interrupt signal is inputted;

outputting the second polarity voltage corresponding to an inverse data of (K+1)-th image data to the electrophoretic display panel, during a second inverse interval;

outputting the first polarity voltage corresponding to the (K+1)-th image to the electrophoretic display panel, during a second display interval, to display the (K+1)-th image on the electrophoretic display panel; and outputting the common voltage to the electrophoretic display panel, during a second holding interval, to hold the (K+1)-th image displayed on the electrophoretic display panel.

5. The method of claim 4, wherein the inverse compensation interval is substantially identical to the first inverse interval, before the interrupt signal is inputted.

6. The method of claim 1, wherein, when the interrupt signal is inputted during the first inverse interval, displaying the (K+1)-th image on the electrophoretic display panel comprises:

outputting the first polarity voltage to the electrophoretic display panel to display the black image, during a second black interval, after the interrupt signal is inputted;

outputting the first polarity voltage to the electrophoretic display panel, during an inverse compensation interval, to compensate a charge that is charged in the particles, before the interrupt signal is inputted;

outputting the second polarity voltage to the electrophoretic display panel to display the white image, during a second white interval;

outputting the second polarity voltage corresponding to an inverse data of the (K+1)-th image to the electrophoretic display panel, during a second inverse interval;

outputting the first polarity voltage corresponding to (K+1)-th image data to the electrophoretic display panel, during a second display interval, to display the (K+1)-th image on the electrophoretic display panel; and outputting the common voltage to the electrophoretic display panel, during a second holding interval, to hold the (K+1)-th image displayed on the electrophoretic display panel.

7. The method of claim 6, wherein the first inverse interval is substantially identical to the inverse compensation interval, before the interrupt signal is inputted.

8. The method of claim 1, wherein, when the interrupt signal is inputted during the first display interval, displaying the (K+1)-th image on the electrophoretic display panel comprises:

outputting the first polarity voltage to the electrophoretic display panel during a second black interval after the interrupt signal is inputted to display the black image;

outputting the second polarity voltage to the electrophoretic display panel during a second white interval to display the white image;

outputting the first polarity voltage to the electrophoretic display panel during a display compensation interval to compensate charges that are charged in the particles before the interrupt signal is inputted;

outputting the second polarity voltage corresponding to an inverse data of (K+1)-th image data to the electrophoretic display panel, during a second inverse interval;

outputting the first polarity voltage corresponding to the (K+1)-th image data to the electrophoretic display panel, during a second display interval, to display the (K+1)-th image; and outputting the common voltage to the electrophoretic display panel, during a second holding interval, to maintain the (K+1)-th image displayed on the electrophoretic display panel.

9. The method of claim 8, wherein a total sum of a first interval, of the first display interval before the interrupt signal is inputted, and the display compensation interval is substantially identical to the first display interval.

10. The method of claim 1, wherein, when the interrupt signal is inputted during the first display interval, displaying the (K+1)-th image on the electrophoretic display panel comprises:

outputting the first polarity voltage to the electrophoretic display panel during a second black interval after the interrupt signal is inputted to display the black image;

outputting the first polarity voltage to the electrophoretic display panel during a display compensation interval to compensate charges that are charged in the particles before the interrupt signal is inputted;

outputting the second polarity voltage to the electrophoretic display panel during a second white interval to display the white image;

outputting the second polarity voltage corresponding to an inverse data of (K+1)-th image data to the electrophoretic display panel, during a second inverse interval;

outputting the first polarity voltage corresponding to the (K+1)-th image data to the electrophoretic display panel, during a second display interval, to display the (K+1)-th image; and outputting the common voltage to the electrophoretic display panel, during a second holding interval, to maintain the (K+1)-th image displayed on the electrophoretic display panel.

11. The method of claim 10, wherein a total sum of a first interval, of the first display interval before the interrupt signal is inputted, and the display compensation interval is substantially identical to the first display interval.

12. The method of claim 1, wherein, when the interrupt signal is inputted during the first holding interval, displaying the (K+1)-th image on the electrophoretic display panel comprises:

outputting the first polarity voltage to the electrophoretic display panel during a second black interval after the interrupt signal is inputted to display the black image;

outputting the second polarity voltage to the electrophoretic display panel during a second white interval to display the white image;

outputting the second polarity voltage corresponding to an inverse data of (K+1)-th image data to the electrophoretic display panel during a second inversion interval;

outputting the first polarity voltage corresponding to the (K+1)-th image data to the electrophoretic display panel during a second display interval to display the (K+1)-th image; and outputting the common voltage to the electrophoretic display panel during a second holding interval to maintain the (K+1)-th image displayed on the electrophoretic display panel.

13. A method of displaying images on an electrophoretic display panel, the method comprising:

displaying a (K)-th image on the electrophoretic display panel comprising a plurality of electrophoretic particles, wherein K denotes a natural number; and compensating a charge of the electrophoretic particles charged in correspondence with the (K)-th image displayed on the electrophoretic display panel before an interrupt signal for converting images is inputted, and displaying a (K+1)-th image on the electrophoretic display panel, when the interrupt signal is inputted during one of a plurality of driving intervals, wherein displaying the (K)-th image on the electrophoretic display panel comprises:

outputting a second polarity voltage with respect to a common voltage, the second polarity voltage being an inverse voltage of a first polarity voltage with respect to the common voltage, to the electrophoretic display panel, during a first white interval to display a white image;

outputting the first polarity voltage to the electrophoretic display panel, during a first black interval to display a black image;

outputting the first polarity voltage corresponding to an inversion data of the (K)-th image to the electrophoretic display panel, during a first inverse interval subsequent the first black interval and the first white interval;

outputting the second polarity voltage corresponding to (K)-th image data to the electrophoretic display panel, during a first display interval subsequent the first inverse interval to display the (K)-th image; and outputting the common voltage to the electrophoretic display panel to maintain the (K)-th image displayed on the electrophoretic display panel, during a first holding interval subsequent the first display interval.

14. The method of claim 13, wherein, when the interrupt signal is inputted during the first white interval, displaying the (K+1)-th image on the electrophoretic display panel comprises:

outputting the second polarity voltage to the electrophoretic display panel during a remaining first white interval generated after the interrupt signal is inputted to display the white image;

outputting the first polarity voltage to the electrophoretic display panel during a second black interval to display the black image;

outputting the first polarity voltage corresponding to an inversion data of (K+1)-th image data to the electrophoretic display panel during a second inverse interval;

outputting the second polarity voltage corresponding to the (K+1)-th image data to the electrophoretic display panel during a second display interval to display the (K+1)-th image; and outputting the common voltage to the electrophoretic display panel during a second holding interval to maintain the (K+1)-th image displayed on the electrophoretic display panel.

15. The method of claim 13, wherein, when the interrupt signal is inputted during the first black interval, displaying the (K+1)-th image on the electrophoretic display panel comprises:

outputting the first polarity voltage to the electrophoretic display panel during a remaining first black interval generated after the interrupt signal is inputted to display the black image;

outputting the first polarity voltage corresponding to an inverse data of (K+1)-th image data to the electrophoretic display panel during a second inverse interval;

outputting the second polarity voltage corresponding to the (K+1)-th image data to the electrophoretic display panel, during a second display interval; and outputting the common voltage to the electrophoretic display panel to maintain the (K+1)-th image displayed on the electrophoretic display panel.

16. The method of claim 13, wherein, when the interrupt signal is inputted during the first inverse interval, displaying the (K+1)-th image on the electrophoretic display panel comprises:

outputting the second polarity voltage to the electrophoretic display panel, during a second white interval remaining after the interrupt signal is inputted, to display the white image;

outputting the first polarity voltage to the electrophoretic display panel, during a second black interval, to display the black image;

outputting the second polarity voltage to the electrophoretic display panel, during an inverse compensation interval, to compensate charges that are charged in the particles before the interrupt signal is inputted;

outputting the first polarity voltage corresponding to an inverse data of (K+1)-th image data to the electrophoretic display panel, during a second inverse interval;

outputting the second polarity voltage corresponding to the (K+1)-th image data to the electrophoretic display panel, during a second display interval, to display the (K+1)-th image; and outputting the common voltage to the electrophoretic display panel, during a second holding interval, to maintain the (K+1)-th image displayed on the electrophoretic display panel.

17. The method of claim 16, wherein the first inverse interval is substantially identical to the inverse compensation interval, before the interrupt signal is inputted.

18. The method of claim 13, wherein, when the interrupt signal is inputted during the first inverse interval, displaying the (K+1)-th image on the electrophoretic display panel comprises:

outputting the second polarity voltage to the electrophoretic display panel, during a second white interval after the interrupt signal is inputted, to display the white image;

outputting the second polarity voltage to the electrophoretic display panel, during an inverse compensation interval, to compensate charges that are charged in the particles before the interrupt signal is inputted;

outputting the first polarity voltage to the electrophoretic display panel, during a second black interval, to display the black image;

outputting the first polarity voltage corresponding to an inverse data of (K+1)-th image data to the electrophoretic display panel during a second inverse interval;

outputting the second polarity voltage corresponding to the (K+1)-th image data to the electrophoretic display panel, during a second display interval, to display the (K+1)-th image; and outputting the common voltage to the electrophoretic display panel, during a second holding interval, to maintain the (K+1)-th image displayed on the electrophoretic display panel.

19. The method of claim 13, wherein, when the interrupt signal is inputted during the first display interval, displaying the (K+1)-th image on the electrophoretic display panel comprises:

outputting the second polarity voltage to the electrophoretic display panel, during a second white interval after the interrupt signal is inputted, to display the white image;

outputting the first polarity voltage to the electrophoretic display panel, during a second black interval, to display the black image;

outputting the second polarity voltage to the electrophoretic display panel during a display compensation interval to compensate a charge that is charged in the particles before the interrupt signal is inputted;

outputting the first polarity voltage corresponding to an inverse interval of the (K+1)-th image to the electrophoretic display panel during a second inverse interval;

outputting the second polarity voltage corresponding to (K+1)-th image data to the electrophoretic display panel during a second display interval to display the (K+1)-th image; and outputting the common voltage to the electrophoretic display panel, during a second holding interval, to maintain the (K+1)-th image displayed on the electrophoretic display panel.

20. The method of claim 19, wherein a total sum of a first interval, of the first display interval before the interrupt signal is inputted, and the display compensation interval is substantially identical to the first display interval.

21. The method of claim 13, wherein, when the interrupt signal is inputted during the first display interval, displaying the (K+1)-th image on the electrophoretic display panel comprises:

outputting the second polarity voltage to the electrophoretic display panel, during a second white interval after the interrupt signal is inputted, to display the white image;

outputting the second polarity voltage to the electrophoretic display panel, during a display compensation interval, to compensate a charge that is charged in the particles before the interrupt signal is inputted;

outputting the first polarity voltage to the electrophoretic display panel during a second black interval to display the black image;

outputting the first polarity voltage corresponding to an inverse data of the (K+1)-th image to the electrophoretic display panel during a second inverse interval;

outputting the second polarity voltage corresponding to (K+1)-th image data to the electrophoretic display panel during a second display interval to display the (K+1)-th image; and outputting the common voltage to the electrophoretic display panel, during a second holding interval, to maintain the (K+1)-th image displayed on the electrophoretic display panel.

22. The method of claim 21, wherein a total sum of a first interval, of the first display interval before the interrupt signal is inputted, and the display compensation interval is substantially identical to the first display interval.

23. The method of claim 13, wherein, when the interrupt signal is inputted during the first holding interval, displaying the (K+1)-th image on the electrophoretic display panel comprises:

outputting the second polarity voltage to the electrophoretic display panel, during a second white interval after the interrupt signal is inputted, to display the white image;

outputting the first polarity voltage to the electrophoretic display panel, during a second black interval, to display the black image;

outputting the first polarity voltage corresponding to an inverse data of the (K+1)-th image to the electrophoretic display panel during a second inverse interval;

outputting the second polarity voltage corresponding to (K+1)-th image data to the electrophoretic display panel during a second display interval to display the (K+1)-th image; and outputting the common voltage to the electrophoretic display panel, during a second holding interval, to maintain the (K+1)-th image displayed on the electrophoretic display panel.

24. An electrophoretic display device comprising:

an electrophoretic display panel comprising a plurality of electrophoretic particles; and a driving section which drives the electrophoretic display panel to display a (K)-th image on the electrophoretic display panel, wherein K denotes a natural number, the driving section driving the electrophoretic display panel to compensate a charge of the electrophoretic particles charged in correspondence with the (K)-th image displayed on the electrophoretic display panel before an interrupt signal is inputted, based on an interrupt signal for converting images which is inputted during one of a plurality of driving intervals, and driving the electrophoretic display panel to display a (K+1)-th image on the electrophoretic display panel, wherein displaying the (K)-th image on the electrophoretic display panel comprises:

displaying a black image on the electrophoretic display panel using a first polarity voltage, during a first black interval;

displaying a white image on the electrophoretic display panel using a second polarity voltage, during a first white interval;

outputting the second polarity voltage corresponding to an inverse data of the (K)-th image to the electrophoretic display panel, during a first inverse interval subsequent the first black interval and the first white interval;

outputting the first polarity voltage corresponding to (K)-th image data to display the (K)-th image on the electrophoretic display panel, during a first display interval subsequent the first inverse interval; and outputting a common voltage to the electrophoretic display panel to hold the (K)-th image displayed on the electrophoretic display panel, during a first holding interval subsequent the first display interval.

* * * * *